US007396279B2

(12) United States Patent
Berman et al.

(10) Patent No.: US 7,396,279 B2
(45) Date of Patent: Jul. 8, 2008

(54) GAMING USING TERMINATING ROAMING WILD POSITIONS

(75) Inventors: Bradley Berman, Minnetonka, MN (US); Adam Martin, St. Louis Park, MN (US); Ryan Strand, Plymouth, MN (US); Jacob Lamb, Plymouth, MN (US)

(73) Assignee: IGT, Reno, NV (US)

( * ) Notice: Subject to any disclaimer, the term of this patent is extended or adjusted under 35 U.S.C. 154(b) by 604 days.

(21) Appl. No.: 10/939,122

(22) Filed: Sep. 10, 2004

(65) Prior Publication Data

US 2006/0058095 A1 Mar. 16, 2006

(51) Int. Cl.
*A63F 9/24* (2006.01)

(52) U.S. Cl. ..... 463/16; 463/20

(58) Field of Classification Search ..... 463/16, 463/18, 25, 9, 20
See application file for complete search history.

(56) References Cited

U.S. PATENT DOCUMENTS 6,089,977 A 7/2000 Bennett
6,251,013 B1 6/2001 Bennett
6,290,600 B1 9/2001 Glasson
6,311,976 B1 11/2001 Yoseloff et al.
6,419,579 B1 7/2002 Bennett
6,439,993 B1 8/2002 O'Halloran
6,517,432 B1 2/2003 Jaffe
6,551,187 B1 4/2003 Jaffe
6,561,900 B1 5/2003 Baerlocher et al.
6,565,433 B1 5/2003 Baerlocher et al.
6,572,472 B1 6/2003 Glavich
6,602,136 B1 8/2003 Baerlocher et al.
6,632,140 B2 * 10/2003 Berman et al. ..... 463/18
6,638,165 B2 10/2003 Uchiyama et al.
6,645,074 B2 * 11/2003 Thomas et al. ..... 463/20
6,672,960 B1 1/2004 B-Jensen
6,676,512 B2 1/2004 Fong et al.
6,780,109 B2 8/2004 Kaminow
6,802,775 B2 * 10/2004 Baerlocher et al. ..... 463/16
6,805,349 B2 * 10/2004 Baerlocher et al. ..... 273/138.2
6,896,615 B2 * 5/2005 Berman ..... 463/20
6,918,832 B2 * 7/2005 Baerlocher et al. ..... 463/20
6,960,133 B1 * 11/2005 Marks et al. ..... 463/20
6,997,804 B2 * 2/2006 Berman ..... 463/20

(Continued)

FOREIGN PATENT DOCUMENTS

WO WO/97/32285 9/1997

*Primary Examiner*—John M. Hotaling, II
*Assistant Examiner*—Damon Pierce
(74) *Attorney, Agent, or Firm*—Bell, Boyd & Lloyd LLP

(57) ABSTRACT

A display grid includes a plurality of grid positions that are presented to a game player. One or more grid positions of the plurality of grid positions are defined as termination positions. One or more wild symbols are moved to grid positions proximate the grid positions associated with the one or more wild symbols using a random process. Winning results are determined using a pay table, based on both the one or more wild symbols and the symbols presented at the grid positions not associated with the one or more wild symbols after a spin. Random movement of the one or more wild symbols to grid positions proximate the grid positions associated with the one or more wild symbols is repeated until the one or more (or all) wild symbols move to the termination positions.

68 Claims, 10 Drawing Sheets

U.S. PATENT DOCUMENTS

| | | | | |
|---|---|---|---|---|
| 7,104,888 | B2 * | 9/2006 | Miereau et al. | 463/20 |
| 7,144,322 | B2 * | 12/2006 | Gomez et al. | 463/20 |
| 7,226,359 | B2 * | 6/2007 | Bussick et al. | 463/20 |
| 2002/0025847 | A1 * | 2/2002 | Thomas et al. | 463/20 |
| 2003/0054874 | A1 | 3/2003 | Kaminow | |
| 2003/0057645 | A1 | 3/2003 | Baerlocher et al. | |
| 2003/0060267 | A1 | 3/2003 | Glavich et al. | |
| 2003/0064778 | A1 * | 4/2003 | Berman et al. | 463/20 |
| 2003/0064795 | A1 * | 4/2003 | Baerlocher et al. | 463/25 |
| 2003/0153382 | A1 | 8/2003 | Vancura | |
| 2003/0190947 | A1 | 10/2003 | Baerlocher et al. | |
| 2003/0190948 | A1 | 10/2003 | Baerlocher et al. | |
| 2003/0220134 | A1 | 11/2003 | Walker et al. | |
| 2004/0048646 | A1 | 3/2004 | Visocnik | |
| 2004/0063488 | A1 * | 4/2004 | Berman | 463/18 |
| 2004/0082378 | A1 | 4/2004 | Peterson et al. | |
| 2004/0132527 | A1 * | 7/2004 | Berman et al. | 463/18 |

* cited by examiner

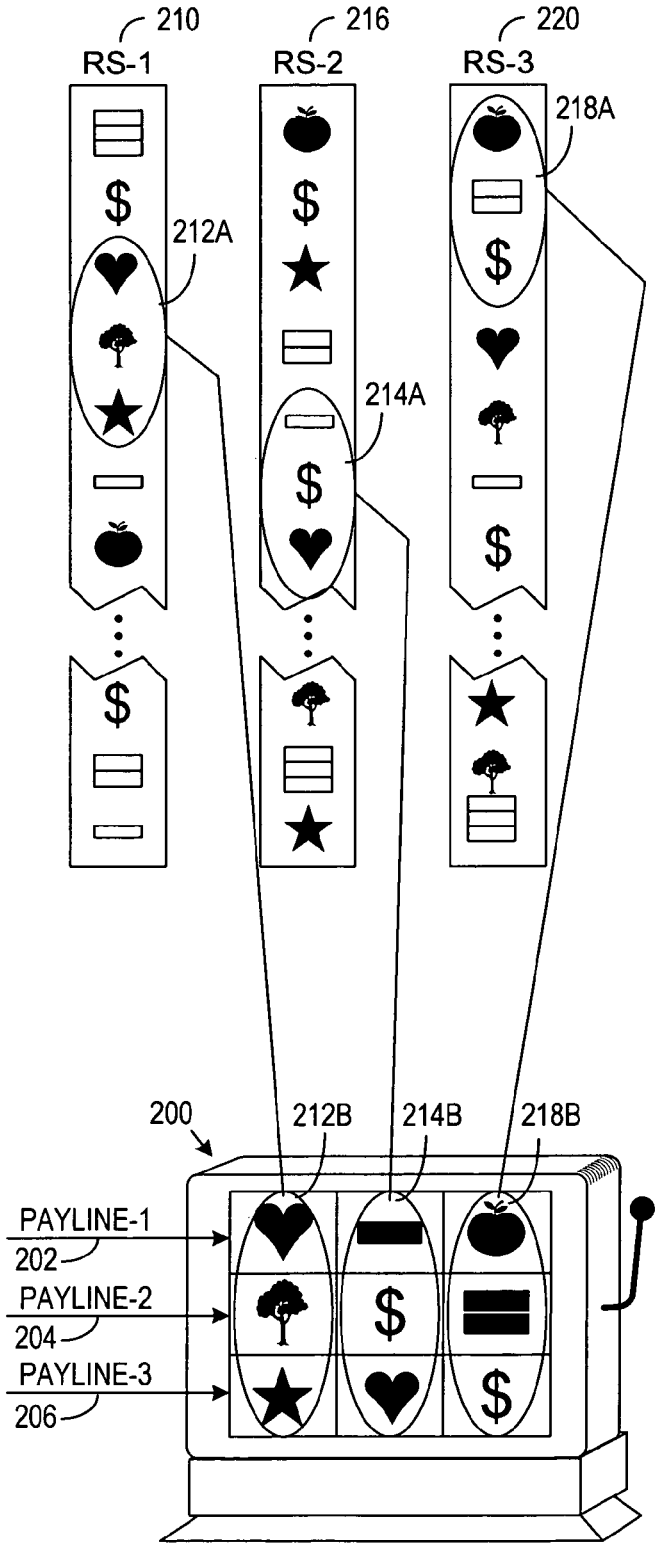
STANDARD MODE
*FIG. 2-A*

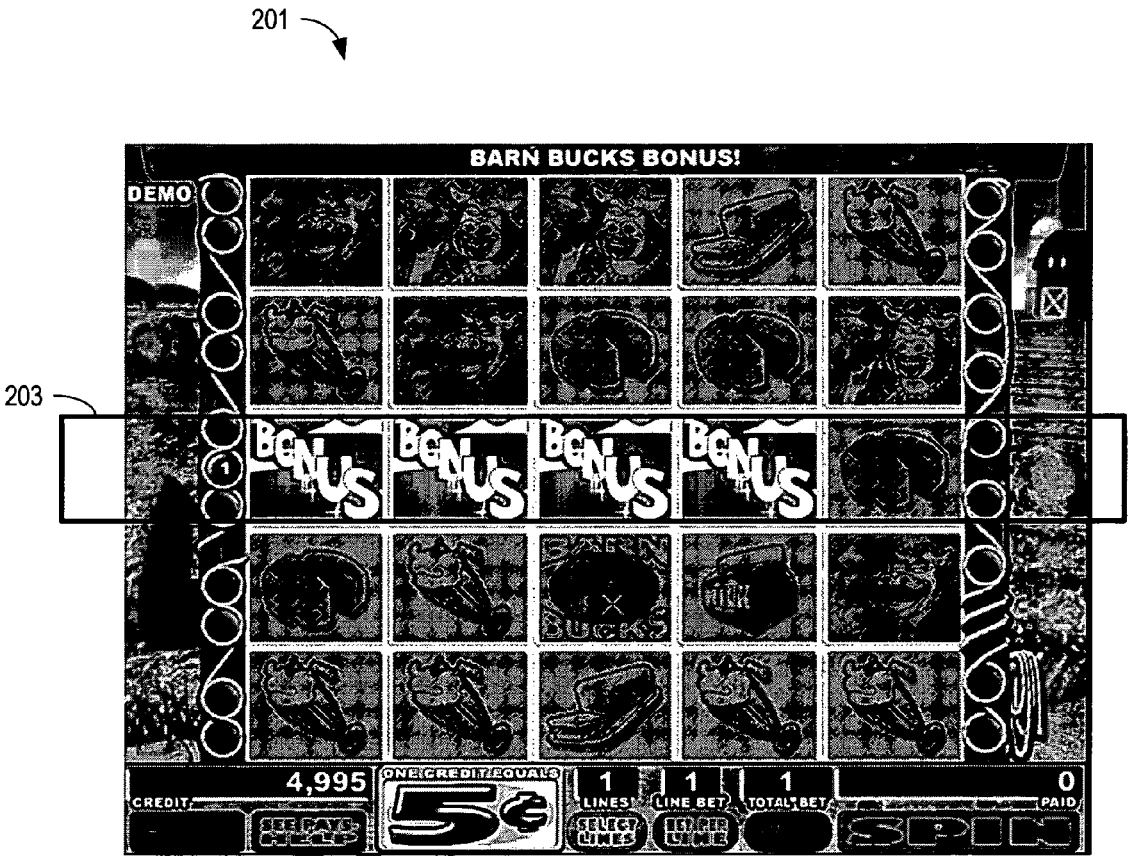
*FIG. 2-B*

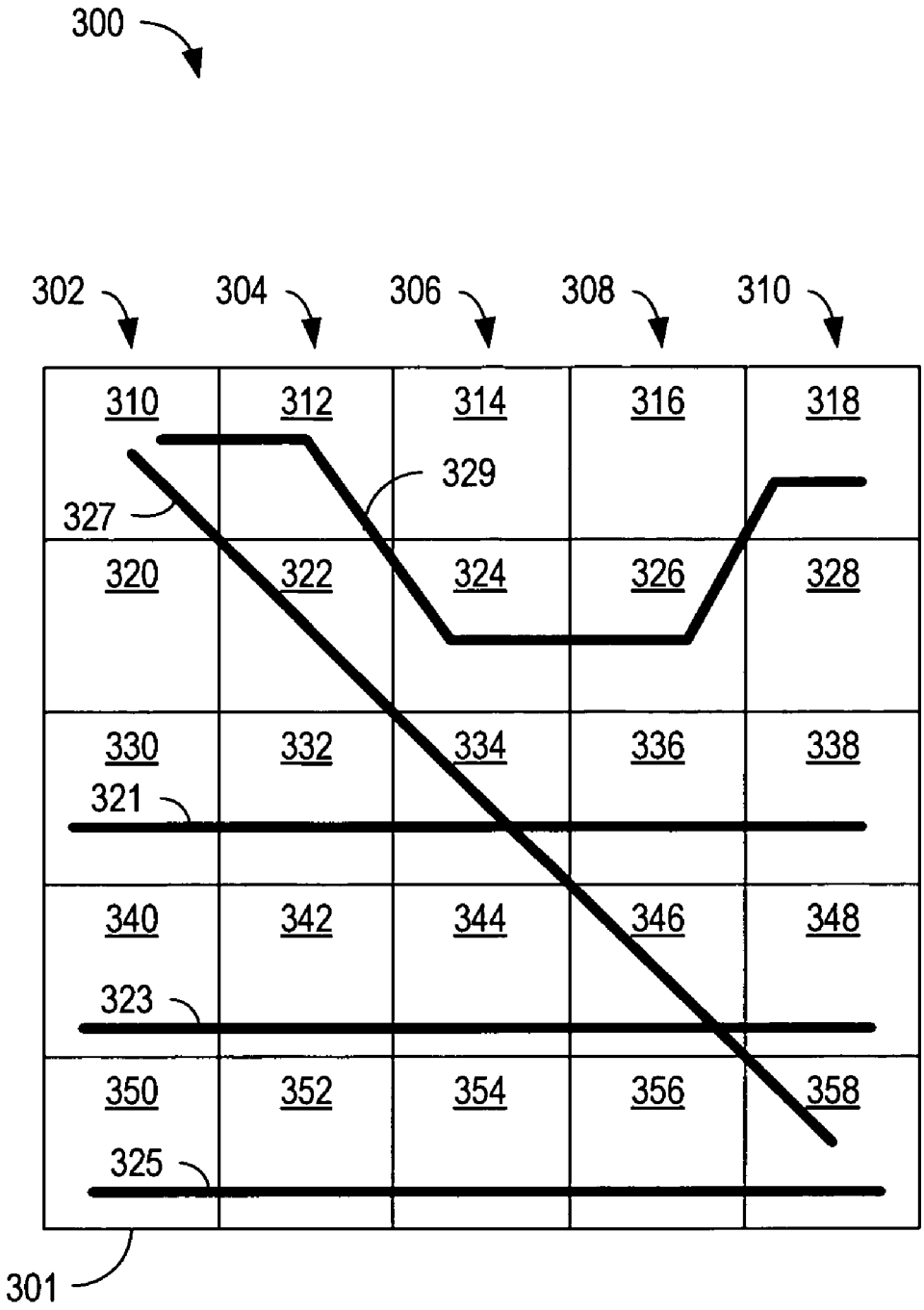
*FIG. 3-A*

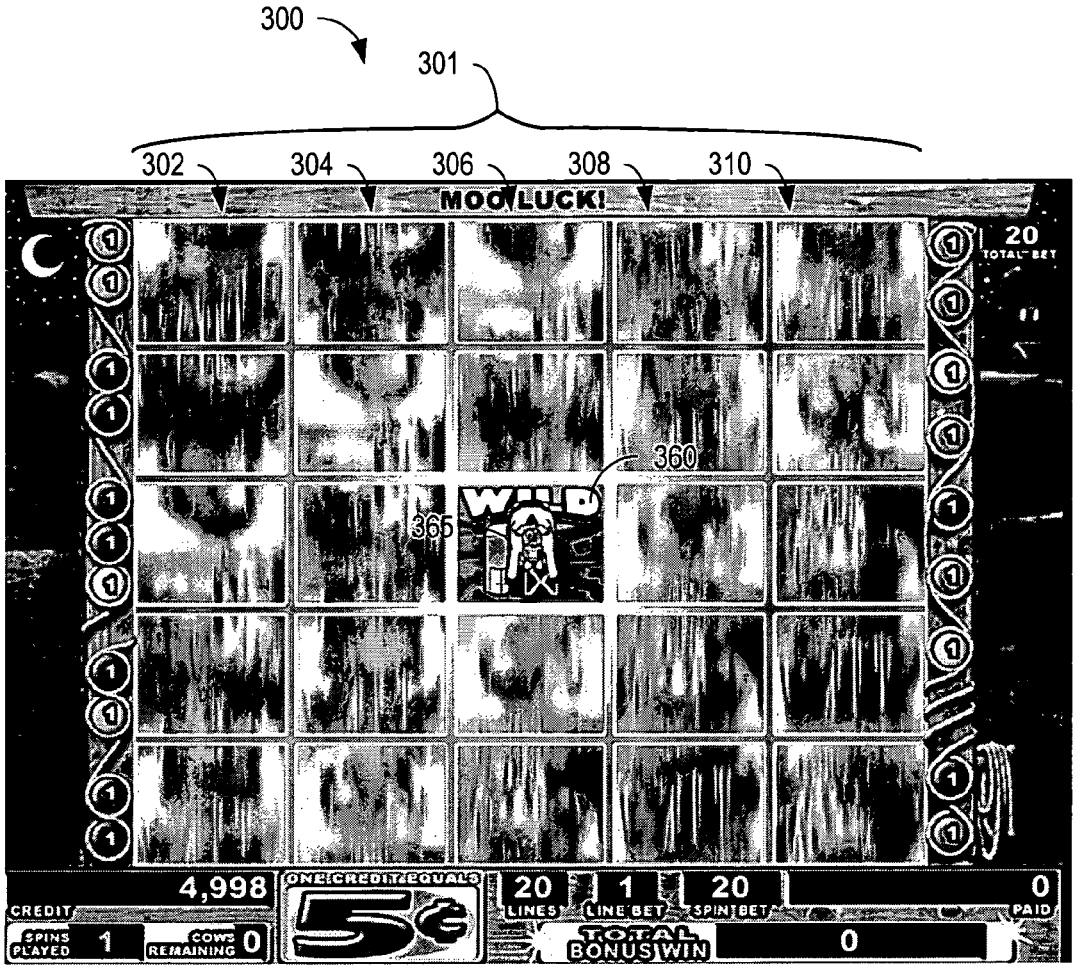
*FIG. 3-B*

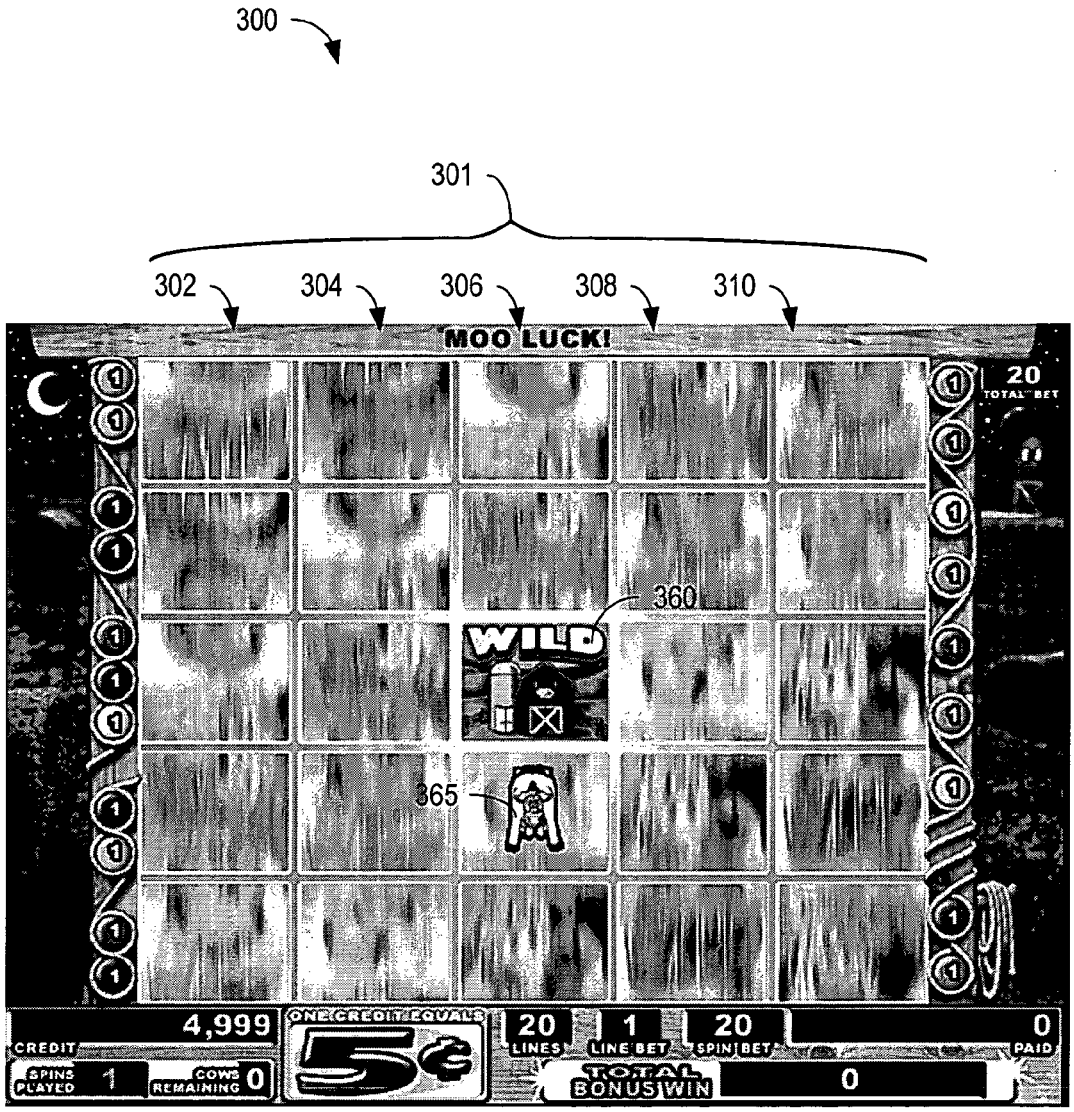
*FIG. 3-C*

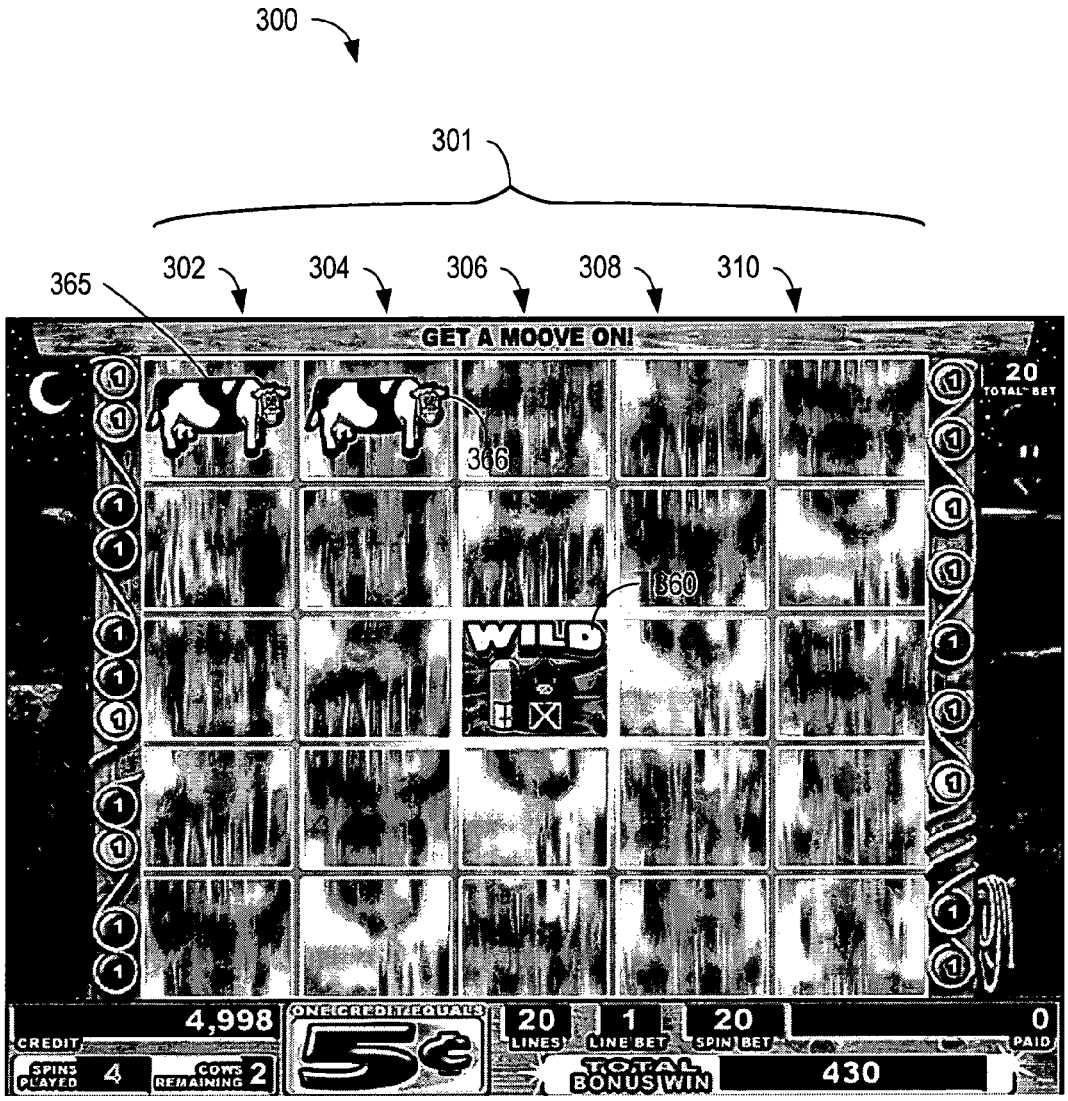
*FIG. 3-D*

GAMING USING TERMINATING ROAMING WILD POSITIONS

FIELD OF THE INVENTION

This invention relates in general to gaming systems and processes, and more particularly to gaming systems and processes employing roaming wilds that terminate at a home position.

BACKGROUND OF THE INVENTION

Gaming devices such as slot machines have been in use in the U.S. for over a century. Notwithstanding the similarity of the symbols and reels associated with the slot machines of both today and yesteryear, modern day slot machine implementations are markedly different than their mechanical ancestors. This dramatic implementation disparity results primarily from the advent of computers and video capabilities. These additional capabilities provide for a greater range of implementation possibilities for the creative and innovative games devised by their creators. While it may be true that a primary motivator for people to play gaming devices may be the chance to win monetary or other prizes (in the case of legalized gambling), the intrigue and excitement of playing these newly created machines lures people as well. It is therefore important in the gaming industry that gaming innovations be rolled out to the participating public.

Conventionally, participation in standard slot machines involves initiating the rotation of multiple reels, and allowing the machine to randomly stop the reel rotation such that associated reel symbols line up a payline. If the symbols on that payline correspond to a predetermined symbol combination, the participant wins an amount corresponding to the particular symbol combination. For multi-lined paylines, a coin or other token may be played for any one or more of the available paylines, and each of the paylines may provide a winning payout. When this occurs, the slot machine pays out according to the payoff table posted on the slot machine. The payoff table informs players of the winning symbol combinations for that machine, and what each combination pays based on the number of coins allocated for the spin. If a winning combination occurs, the machine releases money or tokens into a payout chute, or may award the winning amount onto a credit meter for the player. For example, if a player initially wagered three coins and that player won a high payout, that player may receive fifty coins of the same denomination in return, or may receive fifty credits for continued play.

It is a continual effort in the gaming industry to develop ways to attract and captivate players in playing gaming machines, such as slot games. One such manner of stimulating interest and heightening excitement has been through the use of "bonus" events. Bonus events or games are used to attract and keep players at a gaming machine. A bonus game is typically an additional gaming activity that is enabled by a bonus-qualifying signal from an underlying or primary gaming activity. Generally, a predetermined prize-winning combination of symbols in an underlying or primary game may result in the player being awarded one or more bonus games. Often the bonus event has a much higher probability of winning, thereby instilling a great interest by players in being awarded bonus events.

There are various secondary or "bonus" events known in the art. One such bonus event allows the player to depress a bonus spin button to allow the player one or more additional free spins in which a winning payout may be made. Alternatively, additional, discrete bonus reels may be used for the bonus event. In such case, a particular symbol on any one or more of the reels stopped on a winning line may result in a winning payout. In some bonus activities, the reels may be controllable in a bonus play, unlike the underlying primary gaming play. For example, the reels may be individually stopped, and/or the reels may be rotated slower to allow the player to attempt to stop the reel such that the prize-winning symbol stops on the win line. In another example, a bonus event for a video slot machine may have a second screen where the player is rewarded with a bonus game, such as allowing the player to pick one of five different items on the second screen, and the selected item reveals a value won by the player. In recent times, bonus events have become increasingly captivating, sometimes leading the player through video animations that provide visual and audio entertainment while providing clever ways in which the participant can receive payouts of varying quantities. After engaging in the bonus event, play resumes in the underlying, primary gaming machine.

Of these different types of bonus activities, one type includes those bonus activities where the participant is allowed to actively participate in the bonus event. For example, participants may be allowed to make some sort of selection in order to make the participant feel as though he or she has in some way contributed to the ultimate result. While this may be desirable for some participants, others are more intrigued by the random nature of gaming devices, and may seek an exciting manner of engaging in bonus activities without having to figure out how to best play such a bonus round. This participant sentiment may become increasingly prevalent where the bonus activity is entirely different from the original, standard play of the game. For example, a standard slot machine may have a bonus activity where an animated series of events takes place, and the participant must try to figure out how to effectively play the bonus round. As some bonus activities become more and more elaborate, some participants may be put off by the inherent complexities.

Another problem with prior art bonus activities is that there is conventionally an understood "end" of the bonus activity that is sure to occur. For example, in a bonus round where a participant is allowed to select six of twenty-four hidden bonus amounts, the bonus round ends when the amounts associated with the six selections have been made and credited to the participant. While it may be exciting for the participant to engage in such a bonus round, it is largely due to the participant's knowledge that the bonus round is likely to produce greater payout amounts than during standard play. However, it would be desirable in the gaming industry to provide bonus activity that is terminated based on random events, where although statistically bound, can theoretically continue indefinitely.

The present invention recognizes the strong desirability of bonus activities in today's gaming industry, and addresses the aforementioned and other concerns and shortcomings of present bonus activities. The present invention provides gaming participants with an intelligible gaming activity, which may be employed as a primary and/or secondary (i.e. bonus) activity, while providing an exciting, visually appealing experience for the participant.

SUMMARY OF THE INVENTION

To overcome limitations in the prior art described above, and to overcome other limitations that will become apparent upon reading and understanding the present specification, the present invention discloses a gaming activity and a manner of providing and participating in such a gaming activity. The present invention provides a slot game event where a display grid with a number of grid positions is displayed to a game player. One or more grid positions are defined as termination positions. One or more wild symbols are randomly moved through the grid positions, roaming from position to position until they reach the termination position. Winning results are determined using the wild symbols between moves, as gaming symbols are presented at the grid positions not currently occupied by the roaming wild symbols and/or termination positions. The gaming is repeated as the wild symbols roam, until one or more of the roaming wild symbols or all of the roaming wild symbols are terminated.

In accordance with one embodiment of the invention, a gaming method involves presenting a display grid may include a plurality of grid positions to a game player. One or more grid positions are defined as termination positions. One or more wild symbols are moved to one of the plurality of grid positions. Symbols are presented in each of the grid positions not occupied by the one or more wild symbols between one or more moves of the wild symbol(s). The player is awarded according to a pay table based on the one or more wild symbols and the other symbols presented after a spin. The gaming method is stopped upon movement of the one or more wild symbols to the termination positions.

The one or more wild symbols may be originated from the termination position before moving them to the one of the plurality of grid positions. In embodiments of the present invention, the center grid position may be defined as the termination position. The one or more wild symbols may be repeatedly moved from their current grid position to adjacent grid positions between subsequent presentations of symbols and subsequent awardings of the player, until the one or more wild symbols are moved to the termination position. Movement of wilds from their current grid position to an adjacent grid position may occur according to a rule set, and multiple wild movements may occur between spins.

The probability of a number of repetitions may be determined using one or more movement rules controlling the movement of the one or more wild symbols, or may be determined using explicit probability distributions controlling the movement. Movement rules may include eliminating from consideration at least one position otherwise available for a move in order to adjust the odds of the game. One or more movement rules may include randomly eliminating from consideration at least one position otherwise available for a move, such as randomly eliminating from consideration at least one position away from the termination position that would otherwise be available for a move. One or more movement rules may include eliminating from consideration for a move any position that is currently occupied by a wild symbol. One or more movement rules may include never eliminating from consideration a move to the termination position after the first move. The one or more wild symbols may be depicted as a cow, and a termination position symbol may be depicted as a barn.

In another embodiment of the present invention, a display grid may include a plurality of grid positions is presented to a game player. One or more grid positions of the plurality of grid positions are defined as termination positions. One or more wild symbols are moved to grid positions proximate the grid positions associated with the one or more wild symbols using a random process. Winning results are determined using the one or more wild symbols and presented symbols at the grid positions not associated with the one or more wild symbols. Random movement of the one or more wild symbols to grid positions proximate the grid positions associated with the one or more wild symbols is repeated until the one or more wild symbols move to the termination position(s). Random movement may involve movement according to a rule set having a random component, and/or may involve movement according to a weighted probability distribution that is predefined or determined according to a symbol's current position.

Randomly moving one or more wild symbols may involve distinguishing one or more grid positions as respective wild positions relative to the remaining grid positions, such as by highlighting the one or more wild positions relative to the remaining grid positions. Randomly moving one or more wild symbols may involve randomly moving a visually perceivable wild image to the proximate grid positions to cause the proximate grid positions to serve as respective wild positions. The display grid may be presented using symbols of a mechanical reel arrangement, wherein randomly moving one or more wild symbols to grid positions proximate the grid positions associated with the one or more wild symbols may include distinguishing the positions of the presented symbols from the positions of the remaining positions of the mechanical reel arrangement.

One or more movement rules may be used to randomly eliminate from consideration at least one position that would otherwise be available for a move during the random movement of the one or more wild symbols. Proximate may include vertically adjacent, horizontally adjacent, or diagonally adjacent.

Devices in accordance with the present invention include a casino gaming apparatus hosting a gaming activity having at least a standard mode of operation and a bonus mode of operation, the casino gaming apparatus including a display grid having a plurality of grid positions. A user interface facilitates player participation in at least the standard mode of operation. A processor is configured to enter a bonus mode of operation in response to a predetermined symbol combination occurring during the standard mode of operation, and during the bonus mode of operation to define one grid position of the plurality of grid positions as a termination position. A wild symbol is repeatedly moved to one of the plurality of grid positions, and symbols are presented in each of the grid positions not occupied by the one or more wild symbols for each repetition. The player may be awarded according to a pay table based on the symbols presented. The game may return to the standard mode of operation upon movement of the one or more wild symbols to the termination position. The casino gaming apparatus may be a slot machine, a video poker machine, a video bingo machine, and/or a video keno machine.

These and various other advantages and features of novelty which characterize the invention are pointed out with particularity in the claims annexed hereto and form a part hereof. However, for a better understanding of the invention, its advantages, and the objects obtained by its use, reference should be made to the drawings which form a further part hereof, and to accompanying descriptive matter, in which there are illustrated and described specific examples of an apparatus in accordance with embodiments of the invention.

BRIEF DESCRIPTION OF THE DRAWINGS

The invention is described in connection with the representative embodiments illustrated in the following diagrams.

FIG. 2-A is a block diagram illustrating one embodiment in which physical or virtual reel strips are associated with a slot game in accordance with embodiments of the invention;

FIG. 2-B illustrates a game display having a predetermined symbol combination of four BONUS symbols that initiates a bonus activity in accordance with an embodiment of the present invention;

FIG. 3-A illustrates a display screen having a number of video display segments showing possible exemplary paylines in accordance with embodiments of the present invention;

FIG. 3-B illustrates a display screen having a home termination segment with a wild symbol originating from the home segment in accordance with embodiments of the present invention;

FIG. 3-C illustrates a display screen having a home termination segment with a wild symbol at a segment adjacent to the home segment during a spin of the reels in a bonus game in accordance with embodiments of the present invention;

FIG. 3-D illustrates a display screen having a home termination segment with two wild symbols in horizontally adjacent segments during a spin of the reels in a bonus game in accordance with embodiments of the present invention;

DETAILED DESCRIPTION OF THE ILLUSTRATED EMBODIMENTS

Figure 1:
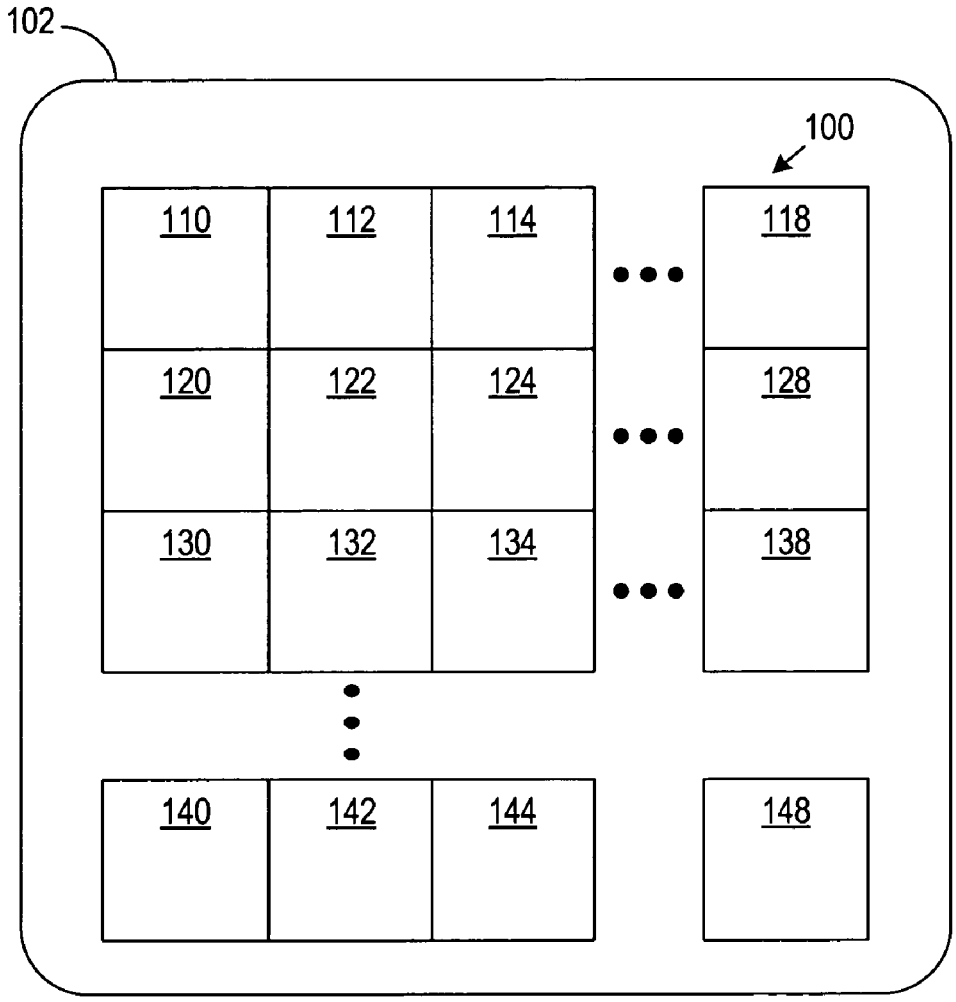
FIG. 1 is a representative example of a slot game grid that may be presented on a slot game display in accordance with the present invention.

In the following description of the invention, reference is made to the accompanying drawings, which form a part hereof, and in which is shown by way of illustration the specific embodiment in which the invention may be practiced. It is to be understood that other embodiments may be utilized, as structural and operational changes may be made without departing from the scope of the present invention.

Generally, the present invention is directed to a method and apparatus for facilitating participation in a slot game, such as that played on a slot machine or other computing apparatus. In accordance with embodiments of the invention, a gaming method involves presenting a display grid, including mechanical and/or electronic implementations, with a number of grid positions to a game player. One or more grid positions are defined as termination positions. One or more wild symbols are randomly moved through the grid positions, roaming from position to position until they reach the termination position. In particular embodiments of the invention, a "spin of the reels" occurs between every movement of the wild symbols. However, the roaming wilds may move more than one position between spins, or may not move between spins. The wild symbols and termination positions may be represented in various manners, including a visual image, an animation, lighting, or other distinguishing feature of the grid positions. Winning results are determined using the wild symbols between moves, as gaming symbols are presented at the grid positions not currently occupied by the roaming wild symbols. The gaming is repeated as the wild symbols roam, until one or more of the roaming wild symbols are terminated.

The present invention, as described more fully below, is applicable to a variety of gaming activities that are played on a gaming machine, including slot games such as reel slots and video slots, electronic poker and other electronic card games, keno, bingo, craps, dice, roulette, etc. The present invention is, however, described in large part in the present description in terms of slot machines to provide an understanding of the invention. For example, in the context of slot games/machines, the present invention allows slot game participants to partake in a standard slot game, while having the opportunity to become engaged in a bonus activity according to the present invention. While the invention is particularly advantageous in the context of slot machines, and while a description in terms of slot machines facilitates an understanding of the invention, the invention is equally applicable to other gaming activities of chance as will be readily apparent to those of skill in the art from the description provided herein.

More particularly, an exemplary gaming system in which the principles of the present invention are particularly beneficial includes at least one standard gaming activity, and at least one bonus activity. For example, in the context of slot machines, a standard gaming activity may include the normal slot game in which the participant places a wager, initiates spinning the mechanical or electronic/video slot game reels, and collects payouts upon the occurrence of one of a plurality of predetermined winning symbol combinations.

A bonus activity is an activity that is often different from the standard gaming activity, and generally occurs only at certain times. In other words, where the standard gaming activity is the gaming activity that is presented to the participant automatically in connection with play of the gaming device, a bonus activity is not automatically presented to the participant. Rather, the bonus activity is generally a special occurrence awarded to the participant for an occurrence resulting from standard gaming play. For example, a bonus event may be awarded to a slot game participant if a resulting symbol combination occurring during standard slot game activity corresponds to a symbol combination determined in advance to result in a bonus event award.

Bonus events are typically used to attract and keep players at a gaming machine that is enabled by a bonus-qualifying signal from an underlying or primary gaming activity. Generally, a predetermined combination of symbols in an underlying game may result in the player being awarded one or more bonus games. Often the bonus event has a much higher probability of winning, thereby instilling a great interest by players in being awarded bonus events.

As is described more fully below, the present invention provides a gaming activity that may be used in connection with a primary gaming activity, and/or a secondary gaming activity such as a bonus event. Thus, while various embodiments of the present invention describe aspects of the invention in connection with a bonus event, those skilled in the art will readily appreciate from the description provided herein that the invention may be utilized in a standard mode of play (e.g., a primary gaming activity/ies), or one or more secondary gaming activities.

In order to provide an understanding of the operation of the invention, FIG. 1 illustrates a representative example of a slot game grid 100 that may be presented on a slot game display 102. Different slot games may exhibit a variety of different reel characteristics and display formats. For example, some slot games include a conventional three-reel configuration traditionally used in mechanical-reel slot machines. In a three-reel configuration, three reels each having an associated reel strip of symbols rotate vertically as viewed by the participant. The reels stop at random locations, thereby presenting the participant with one or more paylines of potentially winning symbol combinations, depending on the amount wagered by the participant. In more recent times, this traditional reel display format has changed significantly, largely due to the ability to present electronic reels on a display screen. This has resulted in a variety of different reel formats, including greater quantities of vertically rotating electronic reels, greater numbers of paylines, and paylines that are vertical, diagonal, mixed, and/or the traditional horizontal paylines. The present invention is applicable with any reel configuration, including symmetric and asymmetric configurations of reels and/or grids. Therefore, the slot game grid 100 of FIG. 1 is shown as having an indeterminate number of rows and columns, which can accordingly represent an indeterminate number of reels, paylines, and the like. It should be recognized that the grid may be provided using electronic means such as video, and/or via mechanical means such as physical reels and associated reel strips.

The slot game grid 100 of FIG. 1 includes a number of rows, which may represent different paylines. However, as will be described more fully below, rows do not necessarily correspond to paylines in accordance with the present invention. Each row includes one or more display segments. The first row includes display segments 110, 112, 114, through some predetermined number of display segments represented by display segment 118. Similarly, a second row includes display segments 120, 122, 124 through 128, and a third row includes display segments 130, 132, 134 through 138. Depending on the number of display segments, rows, paylines, etc. desired, additional rows through the final row are provided, where the final row includes display segments 140, 142, 144 through 148. Thus, FIG. 1 is intended to represent a generic slot game grid having any number or combination of display segments.

In accordance with an exemplary embodiment of the present invention, a predetermined pattern, number of symbols, or other predetermined symbol configuration will initiate a secondary mode of play, referred to herein as a bonus mode of play or bonus event. The bonus event can be initiated by a certain symbol combination arising on any of the paylines of the slot game grid 100, or by a certain predetermined symbol combination arising anywhere on the grid 100.

In one embodiment of the invention, the standard mode of play may implement a first set of physical or electronic (e.g., virtual) reel strips, and the bonus mode of play may implement a different set of reel strips, where each reel strip provides a symbol set. Further, the standard mode of play may implement physical or virtual reel strips where multiple sequential symbols of the reel strip is provided on multiple paylines during the standard mode of play. For example, referring to FIG. 2-A, a slot machine 200 is shown in the standard mode of play. In this example, the standard mode includes three paylines, shown as payline-1 202, payline-2 204, and payline-3 206. The reel strips associated with the standard mode of play may be provided as physical strips having symbols imprinted thereon, such that the stopping point of the reel strip determines which symbols will fall on the paylines 202, 204, 206. For example, a first reel strip, RS-1 210 includes a series of symbols. This reel strip, when stopped, presents a group of symbols on the paylines 202, 204, 206. More particularly, the symbol group 212A is presented across payline-1 202, payline-2 204, and payline-3 206 as seen on the slot machine 200 as symbol group 212B. Analogously, the symbol group 214A of RS-2 216 is presented across paylines 202, 204, 206 as symbol group 214B on the slot machine 200; and the symbol group 218A of RS-3 220 is presented across paylines 202, 204, 206 as symbol group 218B on the slot machine 200. The same may hold true for virtual reel strips, where the order of the symbols on the virtual reel strip may be carried over to the order of the symbols presented across the paylines.

It should be noted that the particular reel strips, number of symbols, and type of symbols presented on the reel strips 230, 232, 234 may differ from one embodiment to the next. For example, each of the reel strips can include a different symbol set altogether, rather than having symbols from a common symbol set such as illustrated in FIG. 2-A. Further, the symbols associated with any of the reel strips may change. For example, after each "spin" in the bonus mode one or more symbols or delineators may be changed, added, and/or removed in order to move the wild symbols as they roam in accordance with embodiments of the present invention, and/or to present the termination position(s). Further, wild symbols and/or termination positions may be delineated by indications external to the "reels." In other embodiments of the present invention, the reel strips 230, 232, 234 may continue to use the original symbols, and the roaming wild(s) and termination position(s) may be presented using, for example, lighting or other method of indicating wild positions and termination positions to the player as the game progresses.

In the example of FIG. 2-B, a predetermined symbol combination of four BONUS symbols initiates the bonus activity. These four BONUS symbols are shown on a payline 203 of a grid 201. It should be noted that any predetermined symbol and/or combination of symbols may initiate the bonus activity, as well as any number of such symbols arising (e.g., one, two, etc.) Again, for purposes of illustration, four BONUS symbols in adjacent positions on a selected payline trigger the bonus mode in the present example.

FIGS. 3-A through 3-D provide a more particular example of a roaming wild, home terminating methodology in accordance with embodiments of the invention. In this example, a video display screen 300 is provided. The video display screen may be implemented in a variety of manners, including electronically represented with outputs shown on conventional electronic displays, such as a liquid crystal displays (LCD), dot matrix, plasma, CRT, LED, electro-luminescent display, or generally any type of video display known in the art.

The display screen 300 of the embodiment illustrated in FIG. 3-A includes a grid 301 including a plurality of video display segments. In one embodiment, the grid includes five vertical virtual reels 302, 304, 306, 308, and 310 that rotate vertically. However, in a video display environment, the electronic reels need not rotate vertically, but may rotate horizontally along rows, or each display segment may rotate independently of other display segments. In this example it is assumed that the electronic reels rotate vertically and in groups defined by reels 302, 304, 306, 308, and 310.

In the standard mode of play, the reels 302, 304, 306, 308, and 310 are electronically rotated. The reels are randomly stopped pursuant to operation of a random number generator (RNG) or other random operation engine. Winning symbol combinations may be presented along a number of different paylines. The example of FIG. 3A includes five paylines, shown as payline-1 321, payline-2 323, payline-3 325, payline-4 327, and payline-5 329. Additional paylines could be implemented, such as along columns, particularly where the standard mode of play randomly selects symbols at each display segment rather than providing a continuous reel strip for each column. In this example, payline-1 321 includes display segments 330, 332, 334, 336, and 338. Payline-2 323 includes display segments 340, 342, 344, 346, and 348. Payline-3 325 includes display segments 350, 352, 354, 356, and 358. Payline-4 327 includes display segments 310, 322, 334, 346, and 358. Finally, payline-5 329 includes display segments 310, 312, 324, 326, and 318.

While the participant may win credits by obtaining predetermined symbol combinations along paylines 321, 323, 325, 327, 329 during the standard mode of play, the present invention also includes a bonus mode of play. Any predetermined symbol criteria may be used to invoke the bonus mode of play. For example, the criteria may be one or more predetermined symbols stopping at predetermined locations in the display segment grid 301. An example is at least one predetermined symbol stopping in each of the reels 302, 304, 306, 308, and 310. Another exemplary criteria is a predetermined number of a predetermined symbol, regardless of where on the grid 301 these predetermined symbols present themselves. As will be readily apparent to those skilled in the art from the foregoing description, a wide variety of options may be implemented to invoke the bonus mode in accordance with embodiments of the invention.

For purposes of discussion, it is assumed that the criteria used in invoke the bonus mode is that a predetermined symbol must present itself in each of the reels 302, 304, 306, and 308. The example of FIG. 2 illustrates that such predetermined symbols presented themselves during standard play on payline 210. This invokes the bonus mode of play.

FIGS. 3B through 3D illustrate an exemplary embodiment of the display screen 300 when the bonus mode is invoked. In this embodiment, a Barn Bucks Bonus is presented to the player, using two cow symbols originating and terminating in a barn, the barn defined as the terminating position for the cows. A barn 360 is illustrated as occupying the center grid position, corresponding to the position 334 of FIG. 3-A. In FIG. 3-B, a first cow 365 is illustrated as exiting the barn 360, and moving to the position vertically adjacent the barn 360, into position 344. In this example, both the barn 360 and the first cow 365 are wild, meaning that they take the attributes of any symbol such that the maximum award, or payout, is provided to the player for each play.

FIG. 3-C illustrates the first cow 365 at the position 344, with the reels 302, 304, 306, 308, and 310 spinning, while the player waits for the reels to stop and subsequently provide a payout according to a pay table, using both the barn 360 and the first cow 365 as wilds. After the reels 302, 304, 306, 308, and 310 are stopped, and any accruing of awards is accomplished, or payout is completed, the first cow 365 will move to another position on the grid, according to a rule set, as will be further described below. If the first cow 365 moves back to the terminating, or home position, (in this example, the barn 360), the bonus play ends, and regular play resumes.

The bonus event may include a second cow 366 that roams the grid during the bonus play, also according to the movement rule set. In the case of two roaming cows 365, 366, the bonus event may not terminate until both cows 365, 366 have returned to the barn 360. FIG. 3-D illustrates a two roaming cow 365, 366 bonus event that will terminate when both cows 365, 366 have returned to the barn 360. The cow's movements may contain some randomness to provide enhanced excitement to the player, who anticipates increased awards for extended bonus play. The probability of the length of bonus play may be controlled using the movement rule set, such as will be described below. The following rule set is one example of rule sets that may be used to provide adjustable probabilities to the wild symbol's movements and termination(s) in accordance with the present invention.

Moolah Barn Bucks Bonus Cow Movement Rule Set:

The Barn Bucks Bonus involves a one or more cows moving within a grid. For this example, two cows will designate moving wild symbols within a 5×5 position grid. At the center of the grid is a terminating position designated, in this case, the BARN. This grid position serves as both the originating and terminating point of the cows' movements. The cows exit the barn one at a time, and then move about the grid according to these rules. The cows exit the bonus when their movements lead them back to the barn. There are six "types" of grid positions in the grid. Five labeled types and the BARN. Each of the labeled types is given a label A-E. The cows' movements are restricted to encourage them to exit the bonus within an acceptable number of rounds. This may be accomplished by paring the list of acceptable next moves, and then selecting randomly from the pared list. The labels of each grid position in the five-by-five grid are shown in Table 1 below.

TABLE 1

| | | | | | | |
|---|---|---|---|---|---|---|
| | | | | | | |
| | | | | | | |
| | A | B | C | B | A | |
| | B | D | E | D | B | |
| | C | E | BARN | E | C | |
| | B | D | E | D | B | |
| | A | B | C | B | A | |
| | | | | | | |
| | | | | | | |
| | | | | | | |

In order to achieve the desired cow movement, there are restrictions placed upon the cow's "choices" of a next move based upon the type of grid position it currently occupies. These restrictions are listed as follows by open grid position type Grid position type A: These are corner grid positions with three adjacent open grid positions. One of the adjacent B grid positions is randomly selected to be eliminated as a possible next move, leaving the other adjacent B grid position and the adjacent D grid position. The cow's next move is selected then randomly between the two remaining grid positions. Type A grid position movement choices are presented in Table 2.

TABLE 2

| | | | | | | |
|---|---|---|---|---|---|---|
| | | | | | | |
| | | | | | | |
| | A | B | | | | |
| | B | D | | | | |
| | | | BARN | | | |
| | | | | | | |
| | | | | | | |
| | | | | | | |
| | | | | | | |
| | | | | | | |

Grid position type B: These are edge grid positions that are not a corner grid position but do border on a corner grid position. In this case one of the adjacent A, B or C grid positions is randomly selected to be eliminated as a possible choice, leaving four possible grid positions as a possible next move. Thus, the D and E grid position join two grid positions from the (A, B, C) group to yield four choices. Type B grid position movement choices are presented in Table 3.

TABLE 3

| | | | | | | |
|---|---|---|---|---|---|---|
| | | | | | | |
| | | | | | | |
| | A | B | | | | |
| | B | D | | | | |
| | C | E | BARN | | | |
| | | | | | | |
| | | | | | | |
| | | | | | | |
| | | | | | | |
| | | | | | | |

Grid position type C: These are edge grid positions that are not corner grid positions and do not border corner grid positions. They are surrounded by 5 neighboring grid positions, and in this case no grid positions will be eliminated as possible next moves. Type C grid position movement choices are presented in Table 4.

TABLE 4

| | | | | | | |
|---|---|---|---|---|---|---|
| | | | | | | |
| | | | | | | |
| | | | | | | |
| | B | D | | | | |
| | C | E | BARN | | | |
| | B | D | | | | |
| | | | | | | |
| | | | | | | |
| | | | | | | |
| | | | | | | |

Grid position types D and E: These grid positions form the inner ring of grid positions, those that are adjacent to the BARN. In the case of both of these types of grid positions, four randomly selected adjacent grid positions are removed as possible next moves, with one notable exception. The BARN grid position is not removed from the list of possible next moves. Thus, the four removed grid positions must come from the 7 adjacent non-BARN grid positions. Types D and E grid position movement choices are presented in Table 5.

TABLE 5

| | | | | | | |
|---|---|---|---|---|---|---|
| | | | | | | |
| | | | | | | |
| | A | B | C | | | |
| | B | D | E | | | |
| | C | E | BARN | | | |
| | | | | | | |
| | | | | | | |
| | | | | | | |
| | | | | | | |
| | | | | | | |

TABLE 5-continued

| | | | | | | |
|---|---|---|---|---|---|---|
| | | | | | | |
| | | | | | | |
| | | | | | | |
| | B | D | E | | | |
| | C | E | BARN | | | |
| | B | D | E | | | |
| | | | | | | |
| | | | | | | |
| | | | | | | |
| | | | | | | |

In each of the above cases, the removal of grid positions slightly increases the chance that the cow will "choose" to move towards the barn. No two cows may occupy the same grid position at the same time, and the first and second cow exit the barn on the first and second round, respectively.

Rules for Multiple Cows' Movement Within a Grid

The following rules apply to movement of the roaming wilds in conjunction with the grid position type rules presented above. The following movement rules will be presented for the example of two roaming, home terminating wilds, generally referred to as 2× and 3×, designating a two times wild cow and a three times wild cow, and therefore provides one representative embodiment.

Rules for When the 2 Cows are on Adjacent Grid Positions

Rules for 2× Moves

If 2× is on grid position type A and 3× is on grid position type B, 2× will move to the open grid position type B or to D.

If 2× is on grid position type A and 3× is on grid position type D, 2× will move to either grid position type B.

If 2× is on grid position type B and 3× is on grid position type A, 2× can move to the open B grid position, the C grid position, the D grid position or the E grid position.

If 2× is on grid position type B and 3× is on grid position type B, 2× can move to the A grid position, the C grid position, the D grid position or the E grid position.

If 2× is on grid position type B and 3× is on C, 2× can move to either the open grid position type B grid position, the A grid position, the D grid position or the E grid position.

If 2× is on grid position type B and 3× is on grid position type D, 2× can move to the open B grid position, the A grid position, the C grid position or the E grid position.

If 2× is on grid position type B and 3× is on grid position type E, 2× can move to the open B grid position, the A grid position, the C grid position or the D grid position.

If 2× is on grid position type C and 3× is on grid position type B, the 2× can move to the open grid position type B, either D grid position or the E grid position.

If 2× is on grid position type C and 3× is on grid position type D, the 2× can move to the open grid position type D, either B grid position or the E grid position.

If 2× is on grid position type C and 3× is on grid position type E, the 2× can move to either B grid position or either D grid position.

If 2× is on grid position type D and 3× is on grid position type A, 3 of the adjacent B, C and E grid positions are eliminated and the 2× can move to the 3 non-eliminated grid positions or the Barn grid position.

If 2× is on grid position type D and 3× is on grid position type B, 3 of the adjacent A, B, C, and E grid positions are eliminated and the 2× can move to the 3 non-eliminated grid positions or the Barn grid position.

If 2× is on grid position type D and 3× is on grid position type C, 3 of the adjacent A, B, C and E grid positions are eliminated and the 2× can move to the 3 non-eliminated grid positions or the Barn grid position.

If 2× is on grid position type D and 3× is on grid position type E, 3 of the adjacent A, B, C and E grid positions are eliminated and the 2× can move to the 3 non-eliminated grid positions or the Barn grid position.

If 2× is on grid position type E and 3× is on grid position type B, 3 of the adjacent B, C, D and E grid positions are eliminated and the 2× can move to the 3 non-eliminated grid positions or the Barn grid position.

If 2× is on grid position type E and 3× is on grid position type C, 3 of the adjacent B, D and E grid positions are eliminated and the 2× can move to the 3 non-eliminated grid positions or the Barn grid position.

If 2× is on grid position type E and 3× is on grid position type D, 3 of the adjacent B, C, D and E grid positions are eliminated and the 2× can move to the 3 non-eliminated grid positions or the Barn grid position.

If 2× is on grid position type E and 3× is on grid position type E, 3 of the adjacent B, C, D and E grid positions are eliminated and the 2× can move to the 3 non-eliminated grid positions or the Barn grid position.

Rules for 3× Moves

If 3× is on grid position type A and 2× is on grid position type B, 3× will move to the open grid position type B or to grid position type D.

If 3× is on grid position type A and 2× is on grid position type D, 3× will move to either grid position type B.

If 3× is on grid position type B and 2× is on grid position type A, 3× can move can move to the open B grid position, the C grid position, the D grid position or the E grid position.

If 3× is on grid position type B and 2× is on grid position type B, 3× can move to the A grid position, the C grid position, the D grid position or the E grid position.

If 3× is on grid position type B and 2× is on grid position type C, 3× can move to either the open B grid position, the A grid position, the D grid position or the E grid position.

If 3× is on grid position type B and 2× is on grid position type D, 3× can move to the open B grid position, the A grid position, the C grid position or the E grid position.

If 3× is on grid position type B and 2× is on grid position type E, 3× can move to the open B grid position, the A grid position, the C grid position or the D grid position.

If 3× is on grid position type C and 2× is on grid position type B, the 3× can move to the open grid position type B, either D grid position or the E grid position.

If 3× is on grid position type C and 2× is on grid position type D, the 3× can move to the open grid position type D, either B grid position or the E grid position.

If 3× is on grid position type C and 2× is on grid position type E, the 3× can move to either B grid position or either D grid position.

If 3× is on grid position type D and 2× is on grid position type A, 3 of the adjacent B, C and E grid positions are eliminated and the 3× can move to the 3 non-eliminated grid positions or the Barn grid position.

If 3× is on grid position type D and 2× is on grid position type B, 3 of the adjacent A, B, C, and E grid positions are eliminated and the 3× can move to the 3 non-eliminated grid positions or the Barn grid position.

If 3× is on grid position type D and 2× is on grid position type C, 3 of the adjacent A, B, C and E grid positions are eliminated and the 3× can move to the 3 non-eliminated grid positions or the Barn grid position.

If 3× is on grid position type D and 2× is on grid position type E, 3 of the adjacent A, B, C and E grid positions are eliminated and the 3× can move to the 3 non-eliminated grid positions or the Barn grid position.

If 3× is on grid position type E and 2× is on grid position type B, 3 of the adjacent B, C, D and E grid positions are eliminated and the 3× can move to the 3 non-eliminated grid positions or the Barn grid position.

If 3× is on grid position type E and 2× is on grid position type C, 3 of the adjacent B, D and E grid positions are eliminated and the 3× can move to the 3 non-eliminated grid positions or the Barn grid position.

If 3× is on grid position type E and 2× is on grid position type D, 3 of the adjacent B, C, D and E grid positions are eliminated and the 3× can move to the 3 non-eliminated grid positions or the Barn grid position.

If 3× is on grid position type E and 2× is on grid position type E, 3 of the adjacent B, C, D and E grid positions are eliminated and the 3× can move to the 3 non-eliminated grid positions or the Barn grid position.

Other Rules

At the start of the bonus game, on the first spin, only the 2× cow comes out.

On spin 2, the 2× moves according the movement rules, but never back in the barn. After the 2× moves, the 3× comes out of the barn.

On the remaining spins, 2× checks for a neighbor and then moves accordingly.

After 2× moves, 3× checks for a neighbor and then moves accordingly. 3× can move to the grid position where the 2× just left, as long as it is in accordance to the movement rules.

The cows can never occupy the same grid position, unless it is the barn.

Both cows cannot enter the barn on the same spin. If 2× enters the barn, 3× moves according to the "no neighbor rules" but cannot enter the barn.

Each cow must move, unless it is in the barn.

If a cow enters the barn, it cannot come back out in the current bonus game.

The above rules are intended to illustrate just one possible rule set that may be used to provide a random movement to the roaming wild symbol(s), while still providing control over the probabilities associated with the game. Other rules sets, or alterations to the above rule set, will be apparent to those skilled in the art. For example, it may be desirable to allow the wild symbols to occupy the same grid position. It may be desirable to allow the wild symbols to change their multiplier or other attribute. For example, it may be desirable to have the wild symbol change to a scatter symbol or other desirable symbol as the wild symbol moves through the grid. It may be desirable to provide two or more symbols, where only one moves or only a limited number move.

It is also contemplated that random movement of the wild symbols may be achieved through processes other than rule sets as described above. Movement probabilities may be controlled implicitly, as described above, or may be pre-determined or calculated explicitly based on a symbols current grid position. For example, a table, such as Table 6 below, may be provided for each grid position to define the probability of a wild symbol's movement to an adjacent grid position, where the percentages may all be different, or some may be the same, depending on the probability distribution desired.

TABLE 6

| | | | |
|---|---|---|---|
| h% | a% | b% | |
| g% | Wild | c% | Home |
| f% | e% | d% | |

Figure 4:
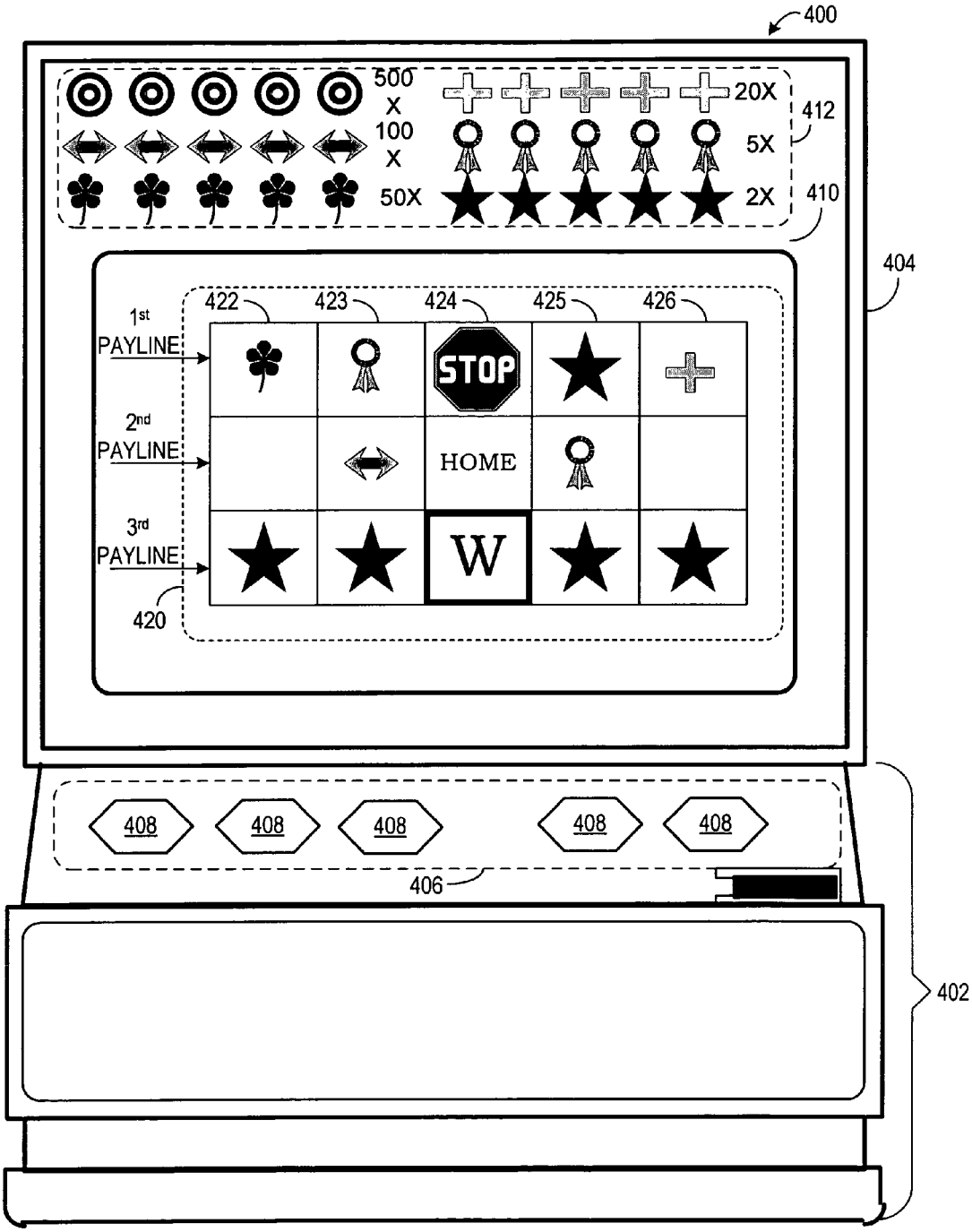
FIG. 4 is an embodiment of a casino-style gaming device in which the principles of the present invention may be applied.

FIG. 4 is an embodiment of a casino-style gaming device in which the principles of the present invention may be applied. Many traditional casino table games may be provided in a "video game" available via a casino-style gaming device shown in FIG. 4. For purposes of explanation, the description of the gaming device is FIG. 4 is provided in terms of a slot machine 400. However, the present invention is analogously applicable to other casino-style games having the ability to include at least one bonus activity.

The slot machine 400 is a structure including at least a computing system, a housing, and a display. The housing includes a base 402 and a display device 404 to allow the slot machine 400 to be a self-supported, independent structure. The base 402 includes structure supporting the slot machine 400, and also includes a user interface 406 to allow the user to control and engage in play of the slot machine 400. The particular user interface mechanisms associated with user interface 406 is dependent on the type of gaming machine. For example, the user interface 406 may include one or more buttons, switches, joysticks, levers, pull-down handles, trackballs, voice-activated input, or any other user input system or mechanism that allows the user to play the particular gaming activity.

The user input 406 allows the user to enter coins or otherwise obtain credits through vouchers, tokens, credit cards, etc. Various mechanisms for entering such vouchers, tokens, credit cards, coins, etc. are known in the art. For example, coin/token input mechanisms, card readers, credit card readers, smart card readers, punch card readers, and other mechanisms may be used to enter wagers. It is through the user input 406 that the user can initiate the standard mode of play, and may optionally control certain aspects of the bonus mode of play.

In the case of a slot machine, the user input may include a plurality of buttons, e.g., button 408, which allow the user to enter a number of credits to play, identify the number of paylines in which to participate, cash out, automatically bet the maximum amount and paylines, etc. It should be recognized that a wide variety of other user interface options are available for use in connection with the present invention, including pressing a button on a gaming machine, touching a segment of a touch-screen, entering text, entering voice commands, or other known user entry methodology. The particular user interface mechanism employed is not relevant to the present invention.

The display device 404 includes a display screen 410. The display device may take on a variety of forms depending on what type of presentation is to be provided. For example, a slot game area 420 is provided where the standard slot gaming activity is displayed. In this example, the standard slot gaming activity includes five video reels 422, 423, 424, 425, and 426, and three paylines depicted as the 1$^{st}$ payline 428, the 2$^{nd}$ payline 430, and the 3$^{rd}$ payline 432. The display segments occur at the intersections of each video reel and payline. Another presentation that may be displayed on the display screen 410 is the bonus payout bar 440, which may optionally be displayed only during the bonus mode of play.

Also associated with the display device 404 is an optional winning guide area 412, where information associated with the potential winning symbol combinations of the standard slot game activity may be presented. This area may also provide an indication of the requisite symbols, symbol combinations, symbol locations, etc. that are required to invoke the bonus mode in accordance with embodiments of the invention. This information may be part of the display screen 410, or alternatively may be separate from the display screen 410 and provided directly on a portion of the display device 404 structure itself. For example, a backlit colored panel may be used as the winning guide area 412.

Figure 5:
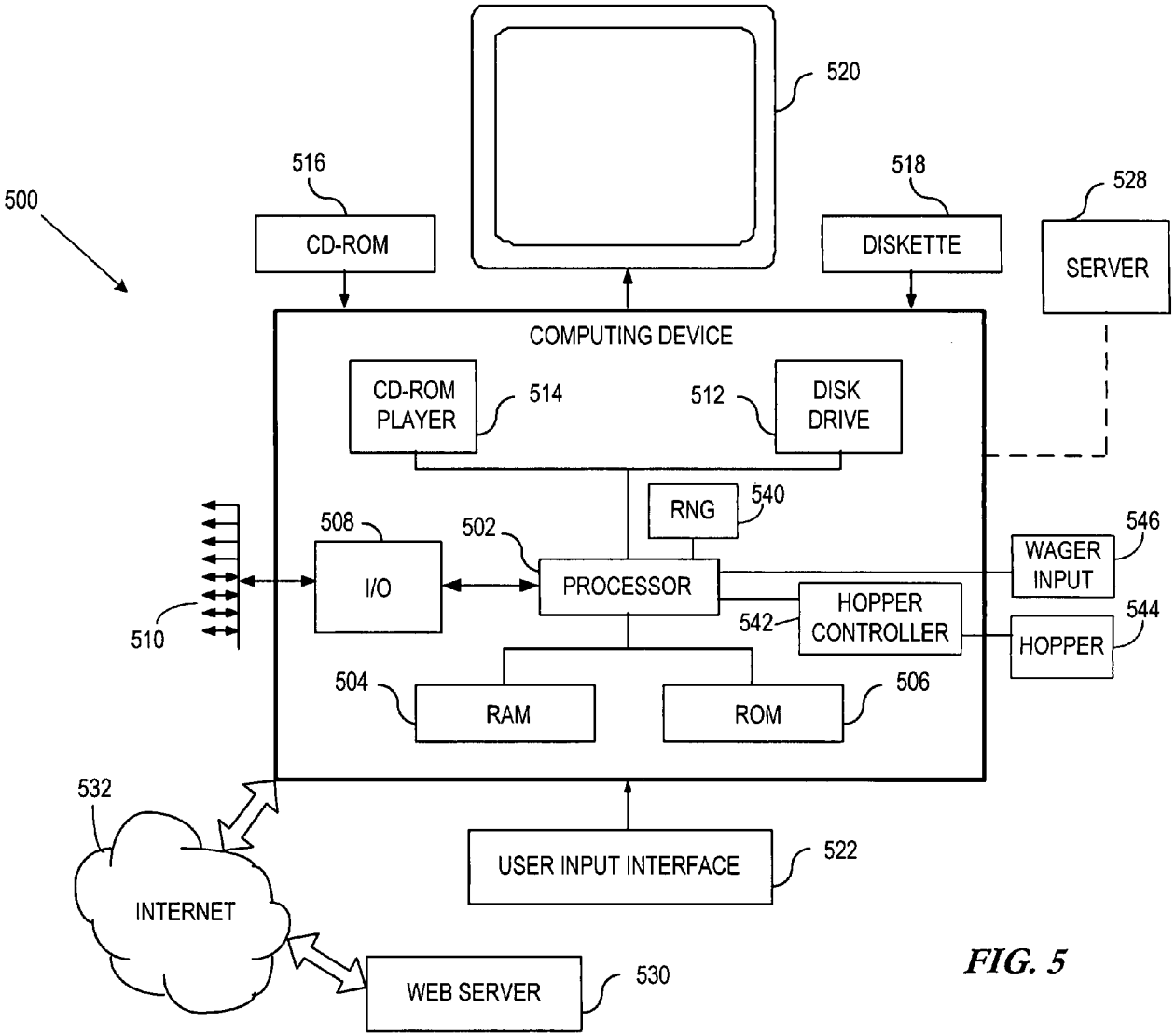
FIG. 5 is a block diagram of a representative computing system capable of carrying out operations in accordance with embodiments of the invention.

The gaming machines described in connection with the present invention may be independent casino gaming machines, such as slot machines or other special purpose gaming kiosks, video games, or may be computing systems operating under the direction of local gaming software and/or remotely-provided software such as provided by an application service provider (ASP). The casino gaming machines utilize computing systems to control and manage the gaming activity. An example of a representative computing system capable of carrying out operations in accordance with embodiments of the invention is illustrated in FIG. 5.

Hardware, firmware, software or a combination thereof may be used to perform the various gaming functions, display presentations and operations described herein. The functional modules used in connection with the invention may reside in a gaming machine as described, or may alternatively reside on a stand-alone or networked computer. The computing structure 500 of FIG. 5 is an example computing structure that can be used in connection with such electronic gaming machines, computers, or other computer-implemented devices to carry out operations of the present invention.

The example computing arrangement 500 suitable for performing the gaming and bonus group elimination functions in accordance with the present invention typically includes a central processor (CPU) 502 coupled to random access memory (RAM) 504 and some variation of read-only memory (ROM) 506. The ROM 506 may also be other types of storage media to store programs, such as programmable ROM (PROM), erasable PROM (EPROM), etc. The processor 502 may communicate with other internal and external components through input/output (I/O) circuitry 508 and bussing 510, to provide control signals, communication signals, and the like.

Random numbers and processors govern chance-based gaming systems such as slot machines, in which the present invention is applicable. Electronic reels are used to display the result of the digital reels, which are actually stored in computer memory and "spun" by a random number generator (RNG). RNGs are well known in the art, and may be implemented using hardware, software operable in connection with the processor 502, or some combination of hardware and software.

In accordance with generally known technology in the field of slot machines, the processor 502 associated with the slot machine, under appropriate program instruction, can simulate the vertical rotation of multiple reels. Generally, the RNG continuously cycles through numbers, even when the machine is not being played. The slot machine selects, for example, three random numbers. The numbers chosen at the moment the play is initiated are typically the numbers used to determine the final outcome, i.e., the outcome is settled the moment the reels are spun. The resulting random numbers are generally divided by a fixed number. This fixed number is often thirty-two, but for slot machines with large progressive jackpots it may be even greater. After dividing, the remainders will be retained. For example, if the divisor were one-hundred and twenty-eight, the machine would have three remainders ranging from zero to one-hundred and twenty-seven. The remainders may be considered as stops on virtual reels. If the divisor was one-hundred twenty-eight, then the virtual reels would each have one-hundred twenty-eight stops with each stop being equally likely. Each stop on the virtual reel may be mapped to a stop on an actual reel or displayed reel image. These reel images may then be displayed on the display 520.

The present invention is operable using any known RNG, and may be integrally programmed as part of the processor 502 operation, or alternatively may be a separate RNG controller 540. RNGs are well known in the art, and any type of RNG may be implemented for the standard mode of play and/or the bonus mode of play in accordance with embodiments of the invention.

The computing arrangement 500 may also include one or more data storage devices, including hard and floppy disk drives 512, CD-ROM drives 514, and other hardware capable of reading and/or storing information such as DVD, etc. In one embodiment, software for carrying out the standard and bonus gaming operations in accordance with the present invention may be stored and distributed on a CD-ROM 516, diskette 518 or other form of media capable of portably storing information. These storage media may be inserted into, and read by, devices such as the CD-ROM drive 514, the disk drive 512, etc. The software may also be transmitted to the computing arrangement 500 via data signals, such as being downloaded electronically via a network, such as the Internet. Further, as previously described, the software for carrying out the functions associated with the present invention may alternatively be stored in internal memory/storage of the computing device 500, such as in the ROM 506.

The computing arrangement 500 is coupled to the display 520, which represents a display on which the gaming activities in accordance with embodiments of the invention are presented. The display 520 merely represents the "presentation" of the video information in accordance with embodiments of the invention, and may be any type of known display or presentation screen, such as LCD displays, plasma display, cathode ray tubes (CRT), etc. Where the computing device 500 represents a stand-alone or networked computer, the display 520 may represent a standard computer terminal or display capable of displaying multiple windows, frames, etc. Where the computing device is embedded within an electronic gaming machine, such as slot machine 400 of FIG. 4, the display 520 corresponds to the display screen 410 of FIG. 4. A user input interface 522 such as a mouse or keyboard may be provided where the computing device 500 is associated with a standard computer. An embodiment of a user input interface 522 is illustrated in connection with an electronic gaming machine 400 of FIG. 4 as the various "buttons" 408. Other user input interface devices include a keyboard, a mouse, a microphone, a touch pad, a touch screen, voice-recognition system, etc.

The computing arrangement 500 may be connected to other computing devices or gaming machines, such as via a network. The computing arrangement 500 may be connected to a network server 528 in an intranet or local network configuration. The computer may further be part of a larger network configuration as in a global area network (GAN) such as the Internet. In such a case, the computer accesses one or more web servers 530 via the Internet 532.

Other components directed to slot machine implementations include manners of gaming participant payment, and gaming machine payout. For example, a slot machine including the computing arrangement 500 may also include a hopper controller 542 to determine the amount of payout to be provided to the participant. The hopper controller may be integrally implemented with the processor 502, or alternatively as a separate hopper controller 542. A hopper 544 may also be provided in slot machine embodiments, where the hopper serves as the mechanism holding the coins/tokens of the machine. The wager input module 546 represents any mechanism for accepting coins, tokens, coupons, bills, credit cards, smart cards, membership cards, etc. for which a participant inputs a wager amount.

Figure 6:
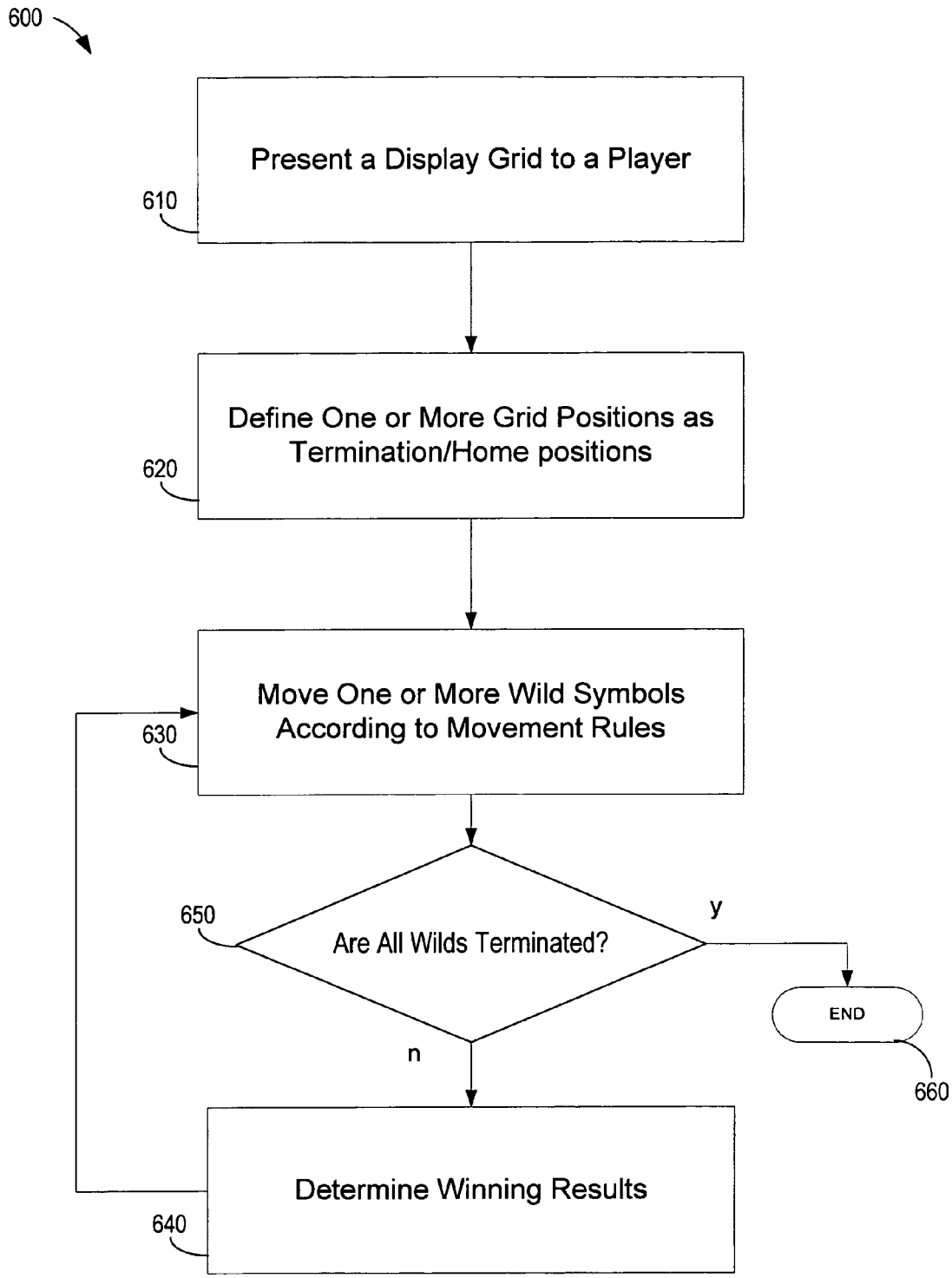
FIG. 6 illustrates a flow chart of a gaming method in accordance with the present invention.

FIG. 6 illustrates a flow chart of a gaming method 600 in accordance with embodiments of the present invention, which may be implemented in a system and/or machine as described above. The method 600 involves presenting 610 a display grid to a game player. One or more grid positions are defined 620 as termination positions, which may also be called home positions, and may further serve as origination positions for one or more wild symbols. One or more wild symbols are moved 630 to grid positions proximate their current position, which may be the home/origination position in the first round of play. Movement 630 may occur according to movement rules established to limit the movement of the wild symbols, and define the odds of the game, such as those described above. Winning results are determined 640 using the one or more wild symbols as play progresses, such as by "spinning the reels" for any grid position not currently occupied by a wild symbol or a termination position. Movement 630 of the one or more wild symbols is repeated to grid positions proximate the grid positions associated with the one or more wild symbols, and winning results are determined 640, until the one or more wild symbols move to the termination positions 650 and the game ends 660.

Using the foregoing specification, the invention may be implemented as a machine, process, or article of manufacture by using standard programming and/or engineering techniques to produce programming software, firmware, hardware or any combination thereof.

Any resulting program(s), having computer-readable program code, may be embodied within one or more computer-usable media such as memory devices or transmitting devices, thereby making a computer program product or article of manufacture according to the invention. As such, the terms "computer readable medium," "article of manufacture," "computer program product" or other similar language as used herein are intended to encompass a computer program which exists permanently, temporarily, or transitorily on any computer-usable medium such as on any memory device or in any transmitting device.

From the description provided herein, one skilled in the art will be able to combine the software created as described with appropriate general purpose or special purpose computer hardware to create a computer system and/or computer subcomponents embodying the invention, and to create a computing system and/or computer subcomponents for carrying out methods of the invention.

Many modifications and variations are possible in light of the above teaching. For example, the present invention is not limited to what is traditionally known as "slot machines." The present invention is applicable to any gaming device allowing participation in primary and/or secondary gaming activities. Also, while the illustrated embodiments have been described in large part in connection with a "slot machine," other gaming systems and concepts are also within the scope of the invention, such as video poker games, card games, lotteries, and other casino events implementing the appropriate display mechanism.

Further, in embodiments where the invention is implemented in a primary gaming activity or other standard mode of play, such embodiments may be configured to allow the participant to continually engage in such a repeated elimination slot game without entering a bonus mode. In such a case, it may be desirable to reduce the amount of the payouts, adjust the pay table, alter the probability of terminating a roaming wild, or otherwise adjusting the probability of winning to maintain desired odds of the gaming device.

As can be seen from the foregoing description, the exemplary embodiments of the invention described herein have been presented for the purposes of illustration and description, and many modifications and variations are possible in light of the above teaching. The description of these exemplary embodiments is not intended to be exhaustive or to limit the invention to the precise form disclosed. It is thus not intended that the scope of the invention be limited with this detailed description, but rather by the claims appended hereto.

What is claimed is:

1. A gaming method, comprising:

(a) displaying a display grid including a plurality of grid positions to a player;

(b) defining one or more grid positions of the plurality of grid positions as termination positions;

(c) originating one or more wild symbols from the termination positions;

(d) moving the one or more wild symbols to respective ones of the plurality of grid positions;

(e) generating symbols in the grid positions not occupied by the one or more wild symbols;

(f) awarding the player in accordance with a pay table and based on the generated symbols and the one or more wild symbols; and (g) repeating steps (d) to (g) until the one or more wild symbols move to the one or more termination positions.

2. The method of claim 1, which includes repeating (d) to (g) until all of the one or more wild symbols move to the one or more termination positions.

3. The method of claim 1, wherein a center grid position is defined as the termination position.

4. The method of claim 1, wherein the one or more wild symbols are repeatedly moved from their current grid position to an adjacent grid position between successive generations of the symbols, until the at least one of the one or more wild symbols are moved to the termination positions.

5. The method of claim 1, wherein the one or more wild symbols are repeatedly moved from their current grid position to an adjacent grid position according to a rule set.

6. The method of claim 1, wherein the one or more wild symbols are repeatedly moved from their current grid position to an adjacent grid position between successive generations of the symbols until the at least one of the one or more wild symbols are moved to the termination positions, the probability of a number of repetitions determined using an explicit probability distribution controlling the movement of the one or more wild symbols.

7. The method of claim 1, wherein the one or more wild symbols are repeatedly moved from their current grid position to a non-adjacent grid position between successive generations of the symbols until the at least one of the one or more wild symbols are moved to the termination positions, the probability of a number of repetitions determined using one or more movement rules controlling the movement of the one or more wild symbols.

8. The method of claim 1, wherein the one or more wild symbols are repeatedly moved from their current grid position to an adjacent grid position between successive generations of the symbols until the one or more wild symbols are moved to the termination positions, the probability of a number of repetitions determined using one or more movement rules controlling the movement of the one or more wild symbols.

9. The method of claim 8, wherein the one or more movement rules include eliminating from consideration at least one position otherwise available for a move.

10. The method of claim 8, wherein the one or more movement rules include randomly eliminating from consideration at least one position otherwise available for a move.

11. The method of claim 8, wherein the one or more movement rules include randomly eliminating from consideration at least one position away from the termination position that would otherwise be available for a move.

12. The method of claim 8, wherein the one or more movement rules include eliminating from consideration for a move any position that is currently occupied by a wild symbol.

13. The method of claim 8, wherein the one or more movement rules include never eliminating from consideration a move to the termination position after the first move.

14. A gaming method, comprising:

(a) defining a bonus event trigger;

(b) displaying a display grid including a plurality of grid positions to a player;

(c) generating symbols in each of the grid positions as a base game for each play by the player, until occurrence of the bonus event trigger;

(d) entering into a bonus game after occurrence of the bonus event trigger;

(e) defining one position of the plurality of positions as a termination position;

(f) originating a first wild symbol from the termination position, the first wild symbol moving to one of the plurality of grid positions;

(g) generating symbols in the grid positions not occupied by the first wild symbol;

(h) awarding the player according to a pay table based on the generated symbols and the first wild symbol;

(i) moving the first wild symbol to a subsequent one of the plurality of grid positions;

(j) repeating steps (g) to (j) until the first wild symbol moves back to the termination position; and (k) returning the player to the base game.

15. The method of claim 14, including: originating a second wild symbol from the termination position, the second wild symbol moving to one of the plurality of grid positions; and moving the second wild symbol to subsequent grid positions.

16. The method of claim 15, wherein the first and second wild symbols are repeatedly moved from their current grid positions to adjacent grid positions between successive events until the first and second wild symbols are both moved to the termination position, wherein each event involves the generating of the symbols in the grid positions and a consequent awarding to the player.

17. The method of claim 15, wherein the first and second wild symbols are repeatedly moved from their current grid position to an adjacent grid position using a rule set.

18. The method of claim 14, wherein the first wild symbol is repeatedly moved from its current grid position to an adjacent grid position between successive events, including the symbol generations and the awarding the player, until the first wild symbol is moved to the termination position, wherein the probability of a number of repetitions is determined using an explicit probability distribution controlling the movement of the first wild symbol.

19. The method of claim 14, wherein the first wild symbol is repeatedly moved from its current grid position to an adjacent grid position between successive events, including the symbol generations and the awarding the player, until the first wild symbol is moved to the termination position, wherein the probability of a number of repetitions is determined using one or more movement rules controlling the movement of the first wild symbol.

20. The method claim 19, wherein the one or more movement rules include eliminating from consideration at least one position otherwise available for a move.

21. The method of claim 19, wherein the one or more movement rules include randomly eliminating from consideration at least one position otherwise available for a move.

22. The method of claim 19, wherein the one or more movement rules include randomly eliminating from consideration at least one position away from the termination position that would otherwise be available for a move.

23. The method of claim 19, wherein the one or more movement rules include eliminating from consideration for a move any position that is currently occupied by the first or second wild symbol.

24. The method of claim 19, wherein the one or more movement rules include never eliminating from consideration a move to the termination position after the first move.

25. The method of claim 19, wherein the one or more movement rules include removing possible moves based on a wild symbol's current grid position.

26. The method of claim 14, wherein a center grid position is defined as the termination position.

27. A gaming method, comprising:

(a) displaying a display grid having a plurality of grid positions to a player;

(b) defining one or more grid positions of the plurality of grid positions as termination positions;

(c) originating one or more wild symbols from the termination positions, the one or more wild symbols moving to one of the plurality of grid positions;

(d) randomly moving the one or more wild symbols to grid positions proximate the grid positions associated with the one or more wild symbols;

(e) determining winning results using the one or more wild symbols and symbols generated at the grid positions not associated with the one or more wild symbols; and (f) repeating steps (d) to (f) until the one or more wild symbols move to the one or more termination positions.

28. The gaming method of claim 27, further including randomly changing the symbols associated with the grid positions not associated with the one or more wild symbols for each move of the wild symbols.

29. The gaming method of claim 27, wherein randomly moving one or more wild symbols includes distinguishing one or more grid positions as respective wild positions relative to the remaining grid positions.

30. The gaming method of claim 29, wherein distinguishing one or more grid positions includes highlighting the one or more wild positions relative to the remaining grid positions.

31. The gaming method of claim 27, wherein randomly moving one or more wild symbols includes randomly moving a visually perceivable wild image to the proximate grid positions to cause the proximate grid positions to serve as respective wild positions.

32. The gaming method of claim 27, wherein randomly moving one or more wild symbols to grid positions proximate the grid positions associated with the one or more wild symbols includes randomly moving the one or more wild symbols to grid positions adjacent to the grid positions associated with the one or more wild symbol.

33. The gaming method of claim 27, wherein randomly moving one or more wild symbols to grid positions proximate the grid positions associated with the one or more wild symbols includes randomly moving the one or more wild symbols to grid positions within a predetermined number of grid positions relative to the grid positions associated with the one or more wild symbols.

34. The gaming method of claim 27, wherein the display grid includes generated symbols of a mechanical reel arrangement, and wherein randomly moving one or more wild symbols to grid positions proximate the grid positions associated with the one or more wild symbols includes distinguishing the positions of the generated symbols from the positions of the remaining positions of the mechanical reel arrangement.

35. The gaming method of claim 27, wherein the display grid includes an electronic display grid, and wherein randomly moving one or more wild symbols to grid positions proximate the grid positions associated with the one or more wild symbols includes visually moving a visually perceivable wild image to electronic grid positions proximate the electronic grid positions associated with the one or more wild symbols.

36. The gaming method of claim 27, wherein the one or more wild symbols are originated from the termination positions.

37. The gaming method of claim 27, wherein one or more movement rules are used to randomly eliminate from consideration at least one position that would otherwise be available for a move during the random movement of the one or more wild symbols.

38. The gaming method of claim 27, wherein the one or more wild symbols are moved for a number of repetitions before moving to the termination position, the probability of the number of repetitions determined using one or more movement rules controlling the movement of the one or more wild symbols.

39. The gaming method of claim 27, wherein the winning results include paylines formed from one or more combinations of the symbols and the one or more wild symbols.

40. The gaming method of claim 27, wherein one or more of the termination positions serve as a wild position.

41. The gaming method of claim 27, wherein the termination position includes a home position.

42. The gaming method of claim 27, including determining winning paylines using the one or more wild symbols and the symbols generated in the grid positions not occupied by the one or more wild symbols.

43. The gaming method of claim 27, wherein a single termination position serves as a home position for a plurality of moving wild symbols.

44. The gaming method of claim 27, wherein randomly moving the one or more wild symbols to grid positions proximate the grid positions associated with the one or more wild symbols includes randomly moving the one or more wild symbols to grid positions adjacent the grid positions associated with the one or more wild symbols.

45. The gaming method of claim 27, wherein randomly moving the one or more wild symbols to grid positions proximate the grid positions associated with the one or more wild symbols includes randomly moving the one or more wild symbols to grid positions vertically adjacent, horizontally adjacent, or diagonally adjacent to the grid positions associated with the one or more wild symbols.

46. The gaming method of claim 27, wherein randomly moving the one or more wild symbols to grid positions proximate the grid positions associated with the one or more wild symbols includes randomly moving the one or more wild symbols to grid positions within a predetermined number of grid positions from current grid positions of the one or more wild symbols.

47. The gaming method of claim 27, wherein movement of the one or more wild symbols to grid positions proximate the wild symbol's current grid position includes presenting an animated movement of the one or more wild symbols to grid positions proximate the wild symbol's current grid position.

48. A casino gaming apparatus hosting a gaming activity having at least a standard mode of operation and a bonus mode of operation, the casino gaming apparatus comprising:

a display device configured to display a display grid having a plurality of grid positions;

a user interface to facilitate player participation in at least the standard mode of operation; and a processor configured to operate with the display device and user interface to:

(a) enter a bonus mode of operation in response to a predetermined symbol combination occurring during the standard mode of operation;

(b) define a grid position of the plurality of grid positions as a termination position;

(c) originate a wild symbol from the termination position;

(d) move the wild symbol to one of the plurality of grid positions;

(e) generate symbols in each of the grid positions not occupied by the one or more wild symbols (f) award the player according to a pay table based on the symbols generated, and (g) repeat steps (d) to (g) until the one or more wild symbols move to the termination position.

49. The casino gaming apparatus of claim 48, wherein the processor includes a random number generator configured to randomly select the symbols for generation in the display grid.

50. The casino gaming apparatus of claim 48, wherein the casino gaming apparatus includes a slot machine, and the standard mode of operation of the slot machine is a slot game.

51. The casino gaming apparatus of claim 48, wherein the casino gaming apparatus includes a video poker machine, and the standard mode of operation of the video poker machine is a poker game.

52. The casino gaming apparatus of claim 48, wherein the casino gaming apparatus includes a video bingo machine, and the standard mode of operation of the video bingo machine is a bingo game.

53. The casino gaming apparatus of claim 48, wherein the casino gaming apparatus includes a video keno machine, and the standard mode of operation of the video keno machine is a keno game.

54. The casino gaming apparatus of claim 48, wherein the processor is configured to originate the one or more wild symbols from the termination position before moving the one or more wild symbols to one of the plurality of grid positions.

55. The casino gaming apparatus of claim 48, wherein the processor is configured to recognize the center grid position as the termination position.

56. The casino gaming apparatus of claim 48, wherein the processor repeatedly moves the one or more wild symbols from its current grid position to an adjacent grid position between successive generations of symbols and awardings of the player until the one or more wild symbols are moved to the termination position.

57. The casino gaming apparatus of claim 48, wherein the processor moves a second wild symbol to one of the plurality of grid positions between repetitions of successive generations of symbols, the second wild symbol terminating upon its movement to the termination position.

58. The casino gaming apparatus of claim 57, wherein the processor is configured to originate both the wild symbol and the second wild symbol from the termination position.

59. The casino gaming apparatus of claim 48, wherein the processor is configured to apply a rule set to repeatedly move the one or more wild symbols from their current grid position to an adjacent grid position between subsequent generations of symbols and subsequent awardings of the player.

60. The casino gaming apparatus of claim 48, wherein the processor is configured to employ an explicit probability distribution to repeatedly move the one or more wild symbols from their current grid positions to an adjacent grid position between subsequent generations of symbols and corresponding awardings to the player, wherein the probability of a number of repetitions is determined using the explicit probability distribution.

61. The casino gaming apparatus of claim 48, wherein the processor is configured to employ a rule set to repeatedly move the one or more wild symbols from their current grid positions to adjacent grid positions between successive generations of symbols and corresponding awardings of the player, wherein the probability of a number of repetitions is determined using one or more movement rules from the rule set.

62. The casino gaming apparatus of claim 61, wherein the one or more movement rules include eliminating from consideration at least one position otherwise available for a move.

63. The casino gaming apparatus claim 61, wherein the one or more movement rules include randomly eliminating from consideration at least one position otherwise available for a move.

64. The casino gaming apparatus of claim 61, wherein the one or more movement rules include randomly eliminating from consideration at least one position away from the termination position that would otherwise be available for a move.

65. The casino gaming apparatus of claim 61, wherein the one or more movement rules include eliminating from consideration for a move any position that is currently occupied by a wild symbol.

66. The casino gaming apparatus of claim 61, wherein the one or more movement rules include never eliminating from consideration a move to the termination position after the first move.

67. A slot machine comprising:

a display device configured to display a display grid including a plurality of grid positions to a player; and a processor configured to operate with the display device to:

(a) define one or more grid positions of the plurality of grid positions as a termination position;

(b) display one or more wild symbols originating from the one or more termination positions;

(c) display the one or more wild symbols moving to one of the plurality of grid positions;

(d) generate symbols in each of the grid positions not occupied by the one or more wild symbols;

(e) display an award to the player according to a pay table based on the one or more wild symbols and the symbols generated; and (f) repeat steps (c) to (f) until the one or more wild symbols move to the one or more termination positions.

68. A computer-readable medium having computer-executable instructions for executing a moving wild home termination bonus event in a slot game, the computer-executable instructions performing steps comprising:

(a) displaying a display grid including a plurality of grid positions to a player;

(b) defining one or more grid positions of the plurality of grid positions as a termination position;

(c) moving one or more wild symbols to respective ones of the plurality of grid positions;

(d) generating symbols in each of the grid positions not occupied by the one or more wild symbols;

(e) awarding the player according to a pay table based on the symbols generated and the one or more wild symbols displayed; and (f) repeating steps (c) to (f) until the one or more wild symbols move to the one or more termination positions.

* * * * *